United States Patent [19]

Lockwood

[11] Patent Number: 4,993,872

[45] Date of Patent: Feb. 19, 1991

[54] PRECAST CONCRETE CULVERT SYSTEM

[75] Inventor: William D. Lockwood, Dayton, Ohio

[73] Assignee: Con/Span Culvert Systems, Inc., Dayton, Ohio

[*] Notice: The portion of the term of this patent subsequent to June 17, 2003 has been disclaimed.

[21] Appl. No.: 390,747

[22] Filed: Aug. 8, 1989

Related U.S. Application Data

[63] Continuation-in-part of Ser. No. 161,499, Feb. 29, 1988, Pat. No. 4,854,775, which is a continuation-in-part of Ser. No. 86,064, Aug. 17, 1987, Pat. No. 4,797,030, which is a continuation-in-part of Ser. No. 853,206, Apr. 17, 1986, Pat. No. 4,687,371, which is a continuation of Ser. No. 566,438, Dec. 28, 1983, Pat. No. 4,595,314.

[51] Int. Cl.[5] ..... E01F 5/00

[52] U.S. Cl. ..... 405/125; 405/53; 405/286

[58] Field of Search ..... 405/46, 53, 55, 124, 405/125, 126, 134, 136, 286; 220/18

[56] References Cited

U.S. PATENT DOCUMENTS

| | | | |
|---|---|---|---|
| 862,292 | 8/1907 | Stoffer | 405/124 |
| 925,019 | 6/1909 | Parks et al. | 405/126 X |
| 1,028,638 | 6/1912 | Thorsby | 405/124 |
| 1,060,271 | 4/1913 | McBean et al. | 405/136 |
| 1,144,200 | 6/1915 | Hewett | 405/125 |
| 1,184,634 | 5/1916 | Duerrwachter | 405/126 X |
| 1,349,166 | 8/1920 | Paff | 405/286 |
| 1,412,616 | 4/1922 | Kammerer et al. | 138/102 |
| 1,453,136 | 4/1923 | Hitchcock | 405/125 |
| 3,570,251 | 3/1971 | Roberts | 405/46 |
| 4,141,666 | 2/1979 | DeGraff | 405/126 |
| 4,211,504 | 7/1980 | Sivachenko | 405/124 X |
| 4,239,416 | 12/1980 | Rorca et al. | 405/53 |
| 4,638,920 | 1/1987 | Goodhues | 220/18 X |
| 4,797,030 | 1/1989 | Lockwood | 405/125 |
| 4,854,775 | 8/1989 | Lockwood | 405/126 |

*Primary Examiner*—David H. Corbin

*Attorney, Agent, or Firm*—Jacox & Meckstroth

[57] ABSTRACT

A precast concrete culvert system includes a series of open bottom culvert sections each having parallel spaced vertical side walls integrally connected to an arcuate top wall having a curved inner surface with a radius of curvature at least twice the rise defined between the top center of the curved inner surface and the bottom surfaces of the side walls. The side walls rest on footers and have outer surfaces which form sharp corners with the top surface of the top wall and have a vertical height at least sixty percent and preferably between eighty and ninety percent of the rise. The vertical height is also less than fifty percent of the radius of curvature which is between twenty and fifty feet and preferably either about twenty-five or forty feet. The end sections have vertical head walls, and the vertical side walls are adapted to connect with angularly disposed vertical concrete wing walls which are precast with anchor walls and provide for a smooth hydraulic flow into and through the series of the culvert sections. Culvert sections may also be precast with a taper to form a curved conduit or be provided with end walls to enclose an underground tank or be precast with parallel spaced and outwardly projecting end ribs.

22 Claims, 3 Drawing Sheets

PRECAST CONCRETE CULVERT SYSTEM

RELATED APPLICATION

This application is a continuation-in-part of application Ser. No. 161,499, filed Feb. 29, 1988, U.S. Pat. No. 4,854,775, which is a continuation-in-part of application Ser. No. 086,064, filed Aug. 17, 1987, U.S. Pat. No. 4,797,030, which is a continuation-in-part of application Ser. No. 853,206, filed Apr. 17, 1986, U.S. Pat. No. 4,687,371, which is a continuation of application Ser. No. 566,438, filed Dec. 28, 1983, U.S. Pat. No. 4,595,314.

BACKGROUND OF THE INVENTION

This invention relates to the production of precast concrete culvert sections which are usually installed in end-to-end alignment in the ground for directing a stream under a roadway and in place of using a bridge for spanning the stream. In the construction of such precast concrete culvert sections, it is desirable for the sections to have a configuration which effectively and efficiently utilizes the lateral forces acting on the side walls of the culvert section by the surrounding earth or soil to provide the culvert section with high strength for supporting substantial vertical loads on the top wall of the section. It is also desirable for the culvert section to have a minimum wall thickness, provide for a smooth flow of water into and through the culvert section and permit the maximum flow of water with a minimum overall height or rise of the culvert section. In addition, it is desirable for the culvert section to be constructed so that culvert sections with different spans and different heights or rises may be economically produced in order to accommodate water streams of various sizes.

Different forms of concrete culvert sections have been either proposed or made, for example, as disclosed in U.S. Pat. No. 1,412,616 and as produced by Zurn Industries, Inc. of Erie, Pa. and marketed under the trademark "BEBO". However, the culvert sections which have been previously proposed or constructed fail to provide all of the above desirable features, as apparent after studying and analyzing the culvert sections.

SUMMARY OF THE INVENTION

The present invention is directed to an improved precast concrete culvert system which provides all of the desirable features mentioned above, including an efficient structure which effectively utilizes the forces exerted by the surrounding soil to provide high strength for supporting substantial vertical loads. The culvert system of the invention may also be efficiently produced in different spans and rises with a simple and economically constructed forming system and provides for attaching precast vertical concrete wing walls to produce a hydraulically smooth flow through the culvert sections. The culvert system may also be used to form a curved water passage and to enclose an underground tank. The above mentioned features and advantages of the invention and other features and advantages will be apparent from the following description, the accompanying drawing and the appended claims.

DESCRIPTION OF THE PREFERRED EMBODIMENTS

Figure 1:
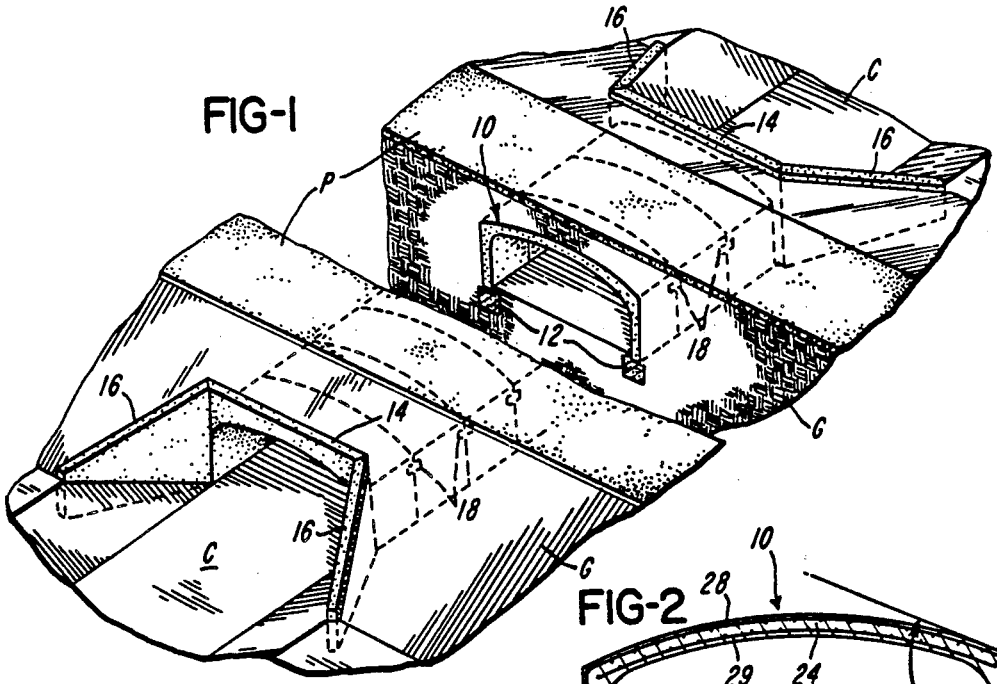
FIG. 1 is a perspective view of an underground installation of a concrete culvert system including several culvert sections constructed in accordance with the invention to provide for a flowing stream under a roadway, and with a center portion broken away.

FIg. 1 illustrates a precast concrete culvert system including a series of precast concrete culvert sections 10 which are placed in alignment or end-to-end on parallel spaced continuous concrete footers 12 formed within trenches in the ground. The footers 12 may be connected by a poured concrete slab, and the assembled culverts 10 are covered by compacted soil G after the culvert sections are placed on the footers 12. The compacted soil supports a roadbed for a roadway or pavement P which extends across the assembled culvert sections. The opposite precast end sections of the assembled culvert sections 10 connect with integral corresponding vertical head walls 14 and vertical wing walls 16 which may be precast and extend outwardly at an angle to define an entrance and exit for water flowing in the channel C formed within the soil. Preferably, adjacent culvert sections 10 are secured together by welding or bolting abutting metal plates 18 having portions embedded with concrete.

Figure 2:
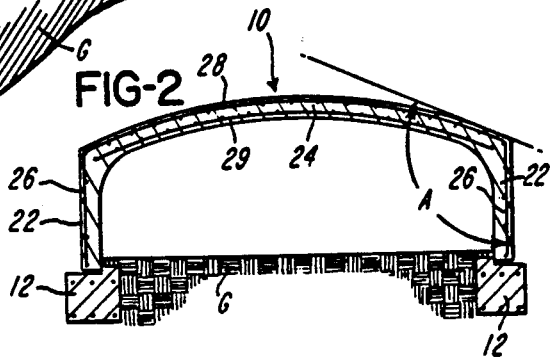
FIG. 2 is a vertical cross-section through one of the culvert sections shown in FIG. 1.
Figure 3:
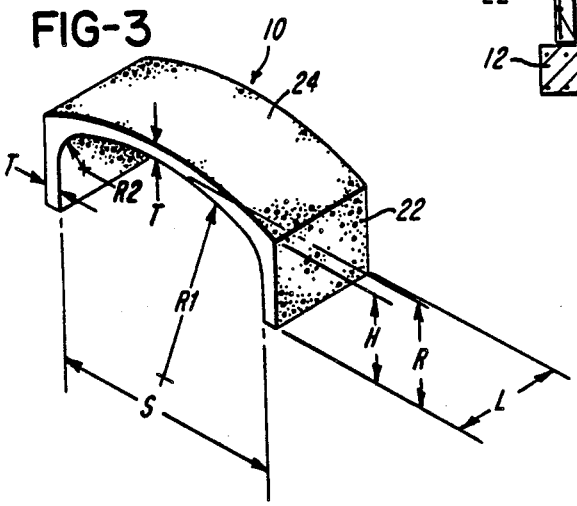
FIG. 3 is a perspective view of a culvert section shown in FIGS. 1 and 2.

Referring to FIGS. 2 and 3, each of the culvert sections 10 includes parallel spaced vertical side walls 22 which are integrally connected to an arcuate top wall 24. The inner surface of the top wall 24 has a radius of curvature R1 which is between twenty feet and fifty feet and preferably about twenty-five feet or forty feet depending on the span S defined between the parallel inner surfaces of the side walls. The thickness T of the side walls and the top wall is within a range of eight inches to fourteen inches, and a thickness T of ten inches has been found suitable for spans S between fourteen feet and thirty-six feet.

The outer surfaces of the side walls 22 have a height H which is at least fifty-five to sixty percent of the rise R defined between the bottom surfaces of the side walls and the top inner surface of the top wall 24. The vertical height H of the side walls 22 is also less than fifty percent of the radius of curvature R1 which is at least twice the rise R. In the optimum construction of each culvert section 10 having a radius of curvature R1 of about twenty-five feet, the height H of the side walls 22 is between seventy and ninety percent of the rise R. In culvert sections having a radius of curvature R1 of about forty feet, the height H of the side walls is preferably between fifty-five and eighty percent of the rise R. The outer surface of each side wall 22 joins with the top surface of the top wall 24 to form a relatively sharp corner with an angle A of between 105 degrees and 120 degrees and preferably about 112 degrees. The length L of each culvert section 10 may range between four feet and ten feet, depending upon the span S, and is preferably about eight feet for most spans. The inner surfaces of the side walls 22 and the top wall 24 are joined together by a curved surface having a radius R2 of about three feet for spans S generally between sixteen and twenty-four feet and a radius of about four feet for greater spans such as thirty and thirty-six feet. This provides the corner portions with a substantially greater thickness. In the longer spans, it is also sometimes desirable to connect or blend the curved surface having a four feet radius with the inner surface of the top wall 24 by means of a curved surface having a ten foot radius.

As shown in FIG. 2, a grid 26 of crossing steel reinforcing roads or members are embedded within the vertical side walls 22 relatively close to the outer surfaces of the side walls, and an arcuate grid 28 of crossing steel reinforcing rods or members is embedded within the top wall 24 relatively close to the upper surface of the top wall. A similar arcuate grid 29 of crossing reinforcing rods or members is also embedded within the top wall 24 relatively close to the inner surface of the top wall. The reinforcing rods forming the grids 26, 28 and 29 substantially increase the load carrying strength of the culvert sections 10 as may be required to handle heavy loads or traffic on the crossing pavement P. In place of the reinforcing bars forming the grids 26, 28 and 29, embedded prestressed tendons, which may be pretensioned or post-tensioned, may be used, or crimped steel fibers or ribbons may be dispersed throughout the concrete when it is being mixed. It has been determined that such reinforcing fibers or ribbons are sufficient reinforcement for many uses of the precast culvert sections.

Figure 4:
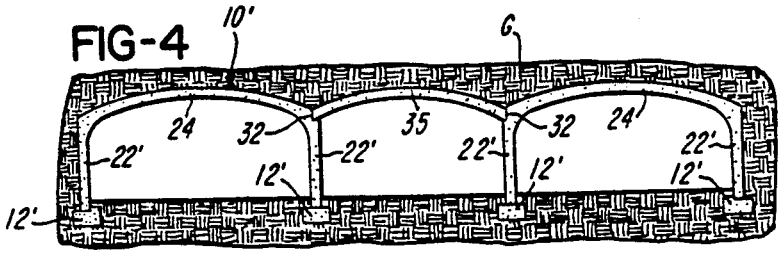
FIG. 4 is an elevational end view of a series of culvert sections assembled and connected in accordance with the invention to provide an underground water retention tank.

Referring to FIG. 4, a series of precast culvert sections 10' are arranged in parallel spaced relation on corresponding continuous concrete footers 12', and each of the culvert sections 10' is provided with a longitudinally extending recess 32 within the upper portion of one side wall 22'. The recesses 32 support precast arcuate concrete panels 35 which have a radius of curvature substantially the same as the radius of curvature R1 of the top walls 24' of the culvert sections 10'. The assembly of the culvert sections 10' and arcuate panels 35 illustrated in FIG. 4 is ideally suited for forming an underground water retention or storage tank. For example, the tank may be used to retain temporarily water collecting from the storm sewers for a large parking lot or other large area which collects a substantial volume of water in a rain storm. The bottom of the tank may be paved with concrete or asphalt.

It has been found that the construction and assembly of culvert sections as described above in accordance with the invention, provides desirable advantages. Specifically, the above described values and relationships between the radius R1, the wall height H and the rise R provide the optimum configuration for utilizing the lateral or horizontal forces acting against the side walls 22 to support the earth or ground G and other loads on the top wall 24. The vertical side walls 22 also provide for connecting the vertical wing walls 16 in a manner which produces a smooth flow of water into and from the culvert formed by the sections 10. The forces of the earth acting horizontally against the upper corners of the side walls 22 are also effective in helping to counteract the outward forces on the side walls 22 by the downward forces or loads on the arcuate top wall 24.

The concrete culvert sections 10 may be efficiently precast on end or in a normal position and in metal forms which provide for conveniently changing the span S and the height H of the side walls 22. That is, the height of the side walls 22 may be varied by repositioning bulkheads within the forms of the side walls, and the span may be conveniently varied by adding or removing curved form sections for the top wall 24 and having the radius R1. Thus the radius R1 remains constant or the same for culvert sections with different spans S, and the corner portions where the side walls 22 join with the top wall 24 also remain substantially constant with culvert sections of different spans S.

Figure 5:
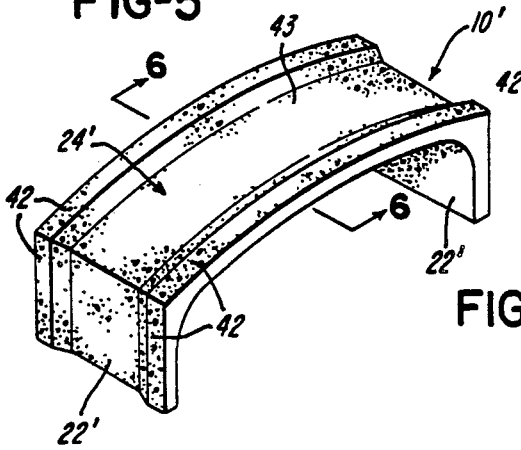
FIG. 5 is a perspective view of a ribbed culvert section constructed in accordance with a modification of the invention.
Figure 6:
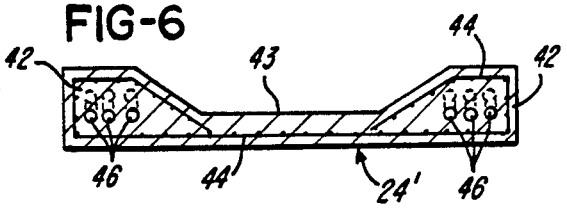
FIG. 6 is a section taken generally on the line 6—6 of FIG. 5.

It is also within the scope of the invention to precast each culvert section with the outer surfaces of the side walls 22 and the top wall 24 with a cavity or recess which reduces the wall thickness within the center portions of the walls and thereby reduces the volume and weight of concrete required to make each section. As shown in FIGS. 5 and 6, a culvert section 10' has walls 22' and 24' with thicker edge or end portions 42 which are connected by a thinner intermediate portion 43 and are provided with additional reinforcing steel 44. For example, the end portions 42 may have a thickness of 12 inches and the intermediate portion 43 a thickness of 5 inches. The end portions 42 may also be provided with tubes or conduits 46 for receiving post-tensioning members or cables.

Figure 7:
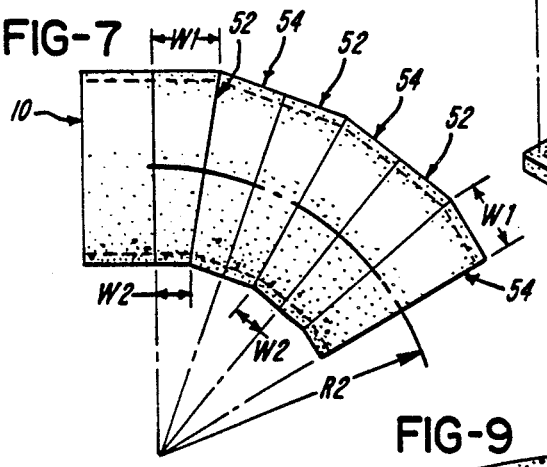
FIG. 7 is a plan view of a series of tapered culvert sections constructed in accordance with the invention to form a curved conduit.

The culvert sections may also be conveniently made in a tapered configuration with one side wall being narrower than the other side wall so that a series of the tapered culvert sections may be arranged on curved footers to form a curved conduit. As shown in FIG. 7, a series of tapered culvert sections 52 and 54 are arranged to provide a radius R2 of centerline curvature. Preferably, the outer side wall of each section 52 and 54 has a width W1 which is no greater than 8 feet, and the width W2 of the inner side wall is selected according to the desired radius R2, but is preferably not less than 2 feet. The tapered sections 52 and 54 are produced simply by filling or blocking in the lower portion of the forms which produce the culvert sections on end. Thus each of the tapered culvert sections 52 and 54 has one end surface which is normal to the side walls and an opposite end surface which is inclined or tapered with respect to the side walls. The tapered sections 52 and 54 are arranged on the footers with the normal end surfaces of two adjacent sections 52 and 54 abutting each other.

Figure 8:
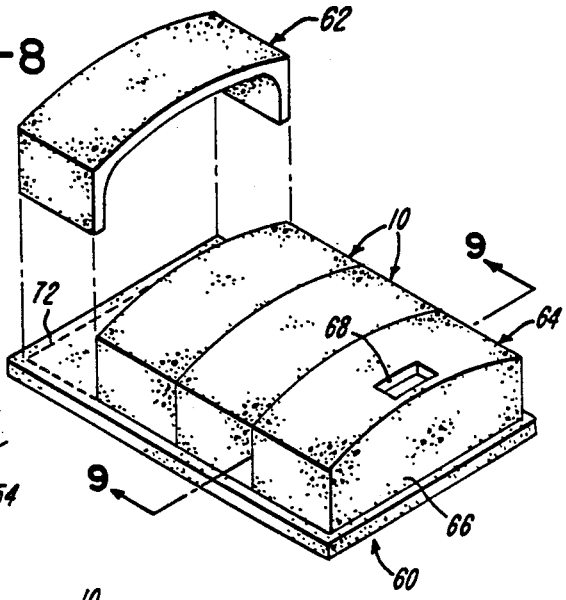
FIG. 8 is a perspective view of an underground tank formed with culvert sections constructed in accordance with the invention.

As mentioned above, the precast concrete culvert sections of the invention may also be used to form an underground tank 60. In the arrangement shown in FIGS. 8 and 9, the opposite end sections 62 and 64 are pre-cast with the same cross-sectional configuration as the culvert sections 10 but with integral vertical end walls 66 and with an access manhole 68 in the top wall of the section 64 near the end wall 66. The sections 10, 62 and 64 are placed on a poured concrete base slab 72 which may be of any length. The assembled sections on the base slab may be provided with an inner coating or liner and/or enclose a rubber-like bladder 74 or "pillow" tank if it is desired to provide a secondary confinement for a specific hazardous material or fluid.

Figure 10:
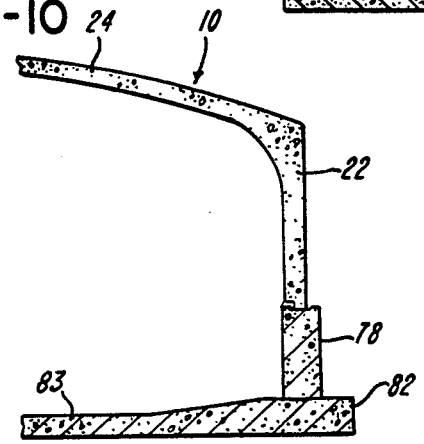
FIG. 10 is a fragmentary section of the culvert section shown in FIG. 3 and mounted on pedestal walls projecting upwardly from footers connected by a base slab.

As shown in FIG. 10, it is also within the scope of the invention to install the culvert sections 10 or 10' on reinforced concrete pedestal walls 78 which are cast on footers 82 and project upwardly by several feet to provide for a larger passage under the sections. The footers 82 may be integrally connected by a reinforced base slab 83 having a predetermined slope towards a lower surface within the center portion of the slab.

Figure 11:
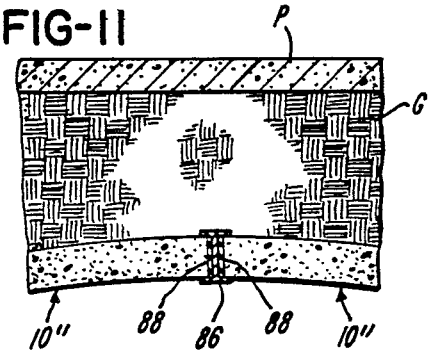
FIG. 11 is a fragmentary section of a split culvert section formed in two half sections, also constructed in accordance with the invention.

Referring to FIG. 11, it si also within the scope of the invention to precast each culvert section 10 or 10' in two half sections or portions 10'' which are coupled or joined together at the top center by means of a longitudinally extending "H" beam 86 or a set of longitudinally spaced short H-shaped brackets. Strips 88 of rubber or resilient bearing pads are placed within the channels defined by the beam 86 to compensate for roughness or irregularities in the abutting edge surfaces of the half culvert sections 10''.

Figure 12:
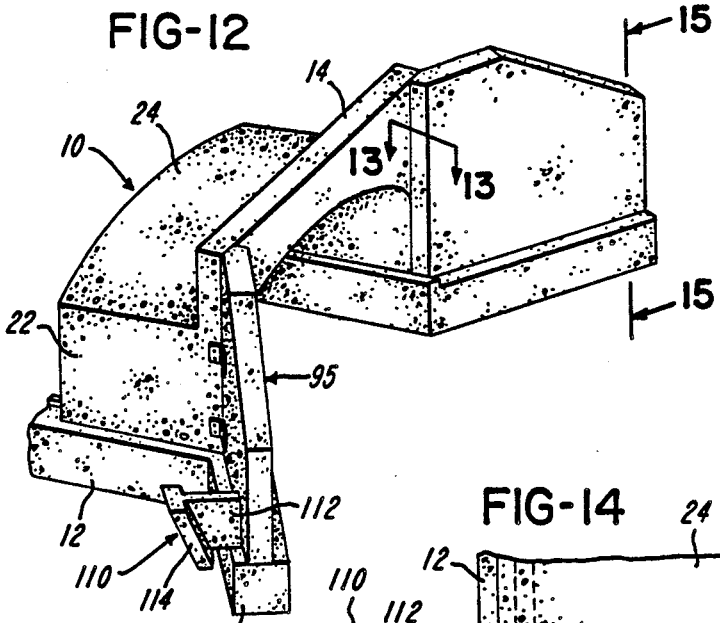
FIG. 12 is a perspective view of an end culvert section supported by footers which also support precast wing walls having integral anchor walls.
Figure 13:
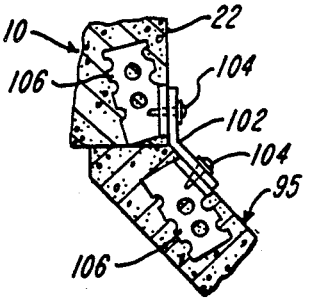
FIG. 13 is a fragmentary section taken generally on the line 13—13 of FIG. 12.
Figure 14:
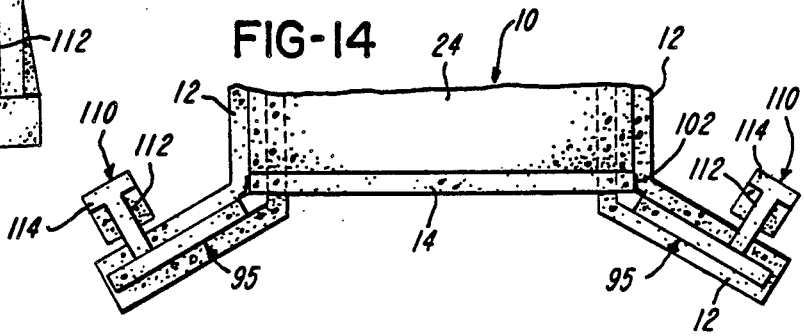
FIG. 14 is a fragmentary plan view of the culvert section and wing walls shown in FIG. 12.
Figure 15:
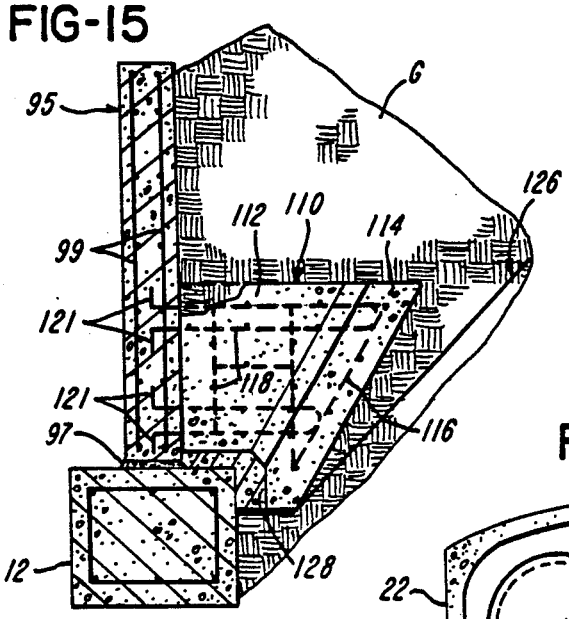
FIG. 15 is a vertical section taken generally on the line 15—15 of FIG. 12.

Referring to FIG. 12, the precast end culvert section 10 includes an integrally cast head wall 14 and is supported by poured concrete footers 12 in the same manner as disclosed above in connection with FIGS. 1-3. FIG. 12 also shows a pair of precast wing walls 95 which are also supported by the footers 12 and are connected to the footers by a layer of grout 97 (FIG. 15). Each of the wing walls 95 includes parallel spaced mats of steel reinforcing bars 99 and is rigidly connected to the adjacent side wall 22 of the end culvert section 10 by a pair of vertically spaced angular tie plates 102. As shown in FIG. 13, each of the tie plates 102 has opposite end portions connected by bolts 104 to corresponding anchor blocks 106 embedded within the side walls 22 of the culvert section 10 and within the wing walls 95.

Each of the precast wing walls 95 includes an integrally connected precast wall anchor 110 having a generally T-shape configuration in horizontal cross section. Each wall anchor 110 includes a vertical web or center wall 112 which connects the wing wall 95 to an inclined head wall or flange portion 114. A mat 116 of reinforcing steel is embedded within each flange portion 114 and is connected to vertically spaced steel reinforcing rods 118 which are embedded within the center wall 112 and have angular end portions 121 embedded within the corresponding wing wall 95. Preferably, the wall anchors 110 are precast with the projecting end portions 121 of the reinforcing rods 118. The wall anchors 110 are then positioned above the forms for precasting the wing walls 95 so that the end portions 121 of the rods depend downwardly into the forms defining the wing walls. Each wing wall 95 is then precast so that the end portions 121 are embedded within the concrete forming the wing wall, thereby forming a rigid and positive connection between each wall anchor 110 and its corresponding wing wall 95.

As shown in FIG. 15, preferably the excavation grade 126 for each wing wall is formed at an incline less than the incline of the outer head or flange portion 114 of the wall anchor 110 and extends downwardly below the top of the footer 12. This permits the assembly of each wing wall 95 and the integrally connected wall anchor 110 to be easily set in place on the supporting footer 12, as shown in FIG. 15. The lower portion of the flange wall 116 of each wall anchor 110 projects downwardly below the connecting wall 112 and below the top surface of the footer 12. Concrete 128 is then poured onto each footer 12 so that the concrete fills the angular space between the wall anchor 110 and the footer 12. After the concrete 128 sets, the back fill or earth G is filled into the space behind each wing wall 95 so that the earth fills the space on opposite sides of the center wall 112 and between the flange portion 114 and the wing wall 95. The earth also fills the space between the grade 126 and the inclined outer surface of each wall anchor 110. The precast wing walls 95, including the integrally connected wall anchors 110, provide for significantly reducing the time required to form the wing walls and thereby significantly reduce the installation cost for a culvert system in accordance with the invention. The wall anchors 110 and concrete 128 retain each wing wall in its installed position.

Figure 9:
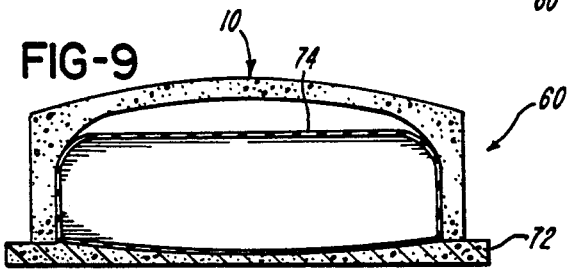
FIG. 9 is a section of the tank taken generally on the line 9—9 of FIG. 8.
Figure 16:
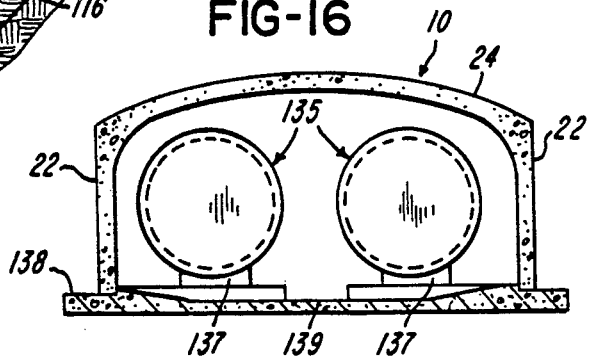
FIG. 16 is a section similar to FIG. 9 and showing another form of underground tank system.

Referring to FIG. 16, a series of culvert sections 10, 62 and 64 as described above in connection with FIG. 8, may also be used for enclosing one or more tanks 135 for containing a liquid. Each of the cylindrical tanks 135 is preferably formed of metal and is supported by a pair of axially spaced saddles 137. The saddles rest on a poured concrete floor 138 having an inner center portion defining a cavity or well 139 as also shown in FIG. 9. As described above, the end culvert section 64 is provided with a manhole 68 which provides access for a person to inspect the tanks 135 periodically, especially when the tanks are used for storing a toxic liquid. In the event a tank 135 developes a leak, the liquid would be confined within the well or cavity 139. The culvert sections are also sealed to each other and to the floor 138 to provide a secondary enclosure for confining any liquid which might leak from a tank 135. Since the tanks 135 are exposed within the culvert system, any leak may be easily detected and repaired. The underground tank and enclosure system shown in FIG. 16 also provides for a rapid and economical installation of underground tanks. That is, after the floor 138 is poured and the tanks 135 are located on the floor, the culvert sections are installed on the floor 138 over the tanks and then covered by the earth. As mentioned above in connection with FIG. 8, the manhole 68 provides access from the ground surface to the space within the sections.

While the precast concrete culvert systems herein described constitute preferred embodiments of the invention, it is to be understood that the invention is not limited to these precise culvert systems, and that changes may be made therein without departing from the scope and spirit of the invention as defined in the appended claims.

The invention having thus been described, the following claimed:

1. A concrete culvert assembly for installation within the ground, comprising a set of elongated footers, a plurality of precast concrete culvert sections supported by said footers in predetermined alignment, each of said culvert sections having an open bottom and including parallel spaced vertical side walls having bottom surfaces supported by said footers, a concrete top wall integrally connected to each of said side walls of each said section, said side walls of each said section having opposing inner surfaces defining a span substantially greater than the length of said side and top walls, each of said side walls of each said section having a generally uniform thickness and a substantially flat vertical outer surface, said concrete top wall of each said section having an outer surface forming a relatively sharp corner with said outer surface of each said side wall, reinforcing members embedded in said concrete of each said section and extending generally parallel to said outer surfaces of said top and side walls, each said side wall and said top wall of each said section having inner surfaces connected by a surface cooperating with said relatively sharp corner to define a corner thickness substantially greater than the uniform thickness of said side wall, a precast concrete wing wall projecting outwardly from each said side wall of the end said culvert section and supported by a corresponding said footer, and each said precast wing wall including a rigidly connected precast wall anchor projecting laterally from said wing wall into the ground above the corresponding said footer.

2. A culvert assembly as defined in claim 1 wherein each said wall anchor includes an inclined outer flange wall connected to the corresponding said wing wall by a web wall disposed generally perpendicular to said wing wall.

3. A culvert assembly as defined in claim 2 wherein said web wall includes embedded reinforcing elements projecting into said wing wall.

4. A culvert assembly as defined in claim 2 wherein said flange wall of each said anchor has a lower end portion projecting downwardly below the corresponding said web wall and the top of the corresponding said footer, and a body of concrete between said lower end portion and the adjacent said footer for securing said wall anchor relative to said footer.

5. A concrete culvert assembly for installation within the ground, comprising a set of elongated footers, a plurality of precast concrete culvert sections supported by said footers in predetermined alignment, each of said culvert sections having an open bottom and including parallel spaced vertical side walls having bottom surfaces supported by said footers, an arcuate concrete top wall integrally connected to each of said side walls of each said section, said side walls of each said section having opposing inner surfaces defining a span substantially greater than the length of said side and top walls, said concrete top wall of each section having a generally uniform thickness with a curved inner surface having a radius of curvature at least twice the rise defined between the top center of said curved inner surface and said bottom surface of said side walls, each of said side walls of each said section having a generally uniform thickness and a substantially flat vertical outer surface, said concrete top wall of each said section having an outer surface forming a relatively sharp corner with said outer surface of each said side wall, reinforcing members embedded in said concrete of each said section and extending generally parallel to said outer surfaces of said top and side walls, said inner surface of each said side wall and said inner surface of said top wall of each said section being connected by a surface cooperating with said relatively sharp corner to define a corner thickness substantially greater than the uniform thickness of said side and top wall, a precast concrete wing wall projecting outwardly from each said side wall of the end said culvert section, and each said wing wall including a rigidly connected precast wall anchor projecting laterally from said wing wall into the ground above the corresponding said footer.

6. A culvert assembly as defined in claim 5 wherein each said wall anchor includes an inclined outer flange wall connected to the corresponding said wing wall by a web wall disposed generally perpendicular to said wing wall.

7. A culvert assembly as defined in claim 6 wherein said web wall includes embedded reinforcing elements projecting into said wing wall.

8. A culvert assembly as defined in claim 6 wherein said flange wall of each said anchor has a lower end portion projecting downwardly below the corresponding said web wall and the top of the corresponding said footer, and a body of concrete between said lower end portion and the adjacent said footer for securing said wall anchor relative to said footer.

9. A concrete culvert assembly comprising a set of elongated footers, a plurality of precast tapered concrete culvert sections mounted on said footers in longitudinal alignment, each of said culvert sections having an open bottom and including parallel spaced vertical side walls having bottom surfaces resting on said footers, a top wall integrally connected to each of said side walls of each said section, said side walls of each said section having opposing inner surfaces defining a span greater than the length of said side and top walls, one of said side walls of each said culvert section having a length less than the length of the other said side wall to provide for curving said culvert assembly, each of said side walls of each said section having a generally uniform thickness and a generally flat vertical outer surface, said concrete top wall of each said section having an outer surface forming a relatively sharp corner with said outer surface of each said side wall, reinforcing members embedded in said concrete of each said section and extending generally parallel to said outer surfaces of said top and side walls, and said inner surface of each said side wall and an inner surface of said top wall of each said section being connected by a surface cooperating with said relatively sharp corner to define a corner thickness substantially greater than the thickness of said side walls.

10. A culvert assembly as defined in claim 9 wherein each of said tapered culvert sections has one end surface normal to said side walls and the opposite end surface inclined relative to said side walls.

11. A concrete assembly for installation within the ground, comprising a concrete base, a series of precast concrete sections mounted on said base in longitudinal alignment, each of said sections having an open bottom and including parallel spaced vertical side walls having bottom surfaces resting on said base, a concrete top wall integrally connected to each of said side walls of each said section, said side walls of each said section having opposing inner surfaces defining a span greater than the length of said side and top walls, each of said side walls of each said section having a generally uniform thickness and a substantially vertical outer surface, said concrete top wall of each said section having an outer surface forming a relatively sharp corner with said outer surface of each said side wall, reinforcing members embedded in said concrete of said section, said inner surface of each said side wall and an inner surface of said top wall of each said section being connected by a surface cooperating with said relatively sharp corner to define a corner thickness substantially greater than the thickness of said side and top walls, a set of end walls on two of said sections to form end sections, all of said sections cooperating with said base to define an enclosed chamber, and means forming at least one fluid receiving tank within said chamber.

12. An assembly as defined in claim 11 wherein said tank comprises a rigid cylindrical tank, and means supporting said tank within said chamber in spaced relation to said base and said side walls of each said section.

13. An assembly as defined in claim 11 and including two of said cylindrical tanks disposed within said chamber with generally parallel axes.

14. An assembly as defined in claim 11 wherein one of said section includes means defining a manhole within said top wall of said section to provide for convenient inspection of said tank.

15. A system for installation within a cavity in the ground for storing a fluid, comprising means forming a base at the bottom of the cavity, a set of inverted U-shaped precast concrete sections mounted on said base in longitudinal alignment, each of said sections including horizontally spaced side walls integrally connected by a concrete top wall and having an open bottom, each of said side walls of each said section being supported by said base and having a generally vertical outer surface, reinforcing members embedded in said concrete of each said section, means forming generally vertical end walls on two of said sections to form end sections, all of said sections cooperating with said base to define an enclosed chamber, at least one fluid receiving tank disposed within said chamber, and means defining a manhole within one of said sections to provide for inspection of said tank within said chamber.

16. A method of forming an underground storage for a fluid, comprising the steps of precasting a set of inverted U-shaped concrete sections each having an open bottom and horizontally spaced side walls integrally connected by a top wall, precasting end walls for two of the sections, forming a manhole in one of the sections, digging a cavity in the ground, forming a generally horizontal base at the bottom of the cavity, positioning at least one fluid receiving tank on the base within the cavity, positioning the concrete sections over the tank with the side walls supported by the base and to define a chamber enclosing the tank, and filling the cavity with an earth material to cover the precast concrete sections.

17. A concrete culvert assembly for installation within the ground, comprising a set of elongated footers, a plurality of precast concrete culvert sections supported by said footers in predetermined alignment, each of said culvert sections having an open bottom and including spaced side walls having bottom surfaces supported by said footers, a concrete top wall integrally connecting said side walls of each said section, said side walls of each said section having opposing inner surfaces defining a span substantially greater than the length of said side and top walls, reinforcing members embedded in said concrete of each said section and extending generally parallel to said outer surfaces of said walls, a one-piece precast concrete wing wall projecting outwardly from each said side wall of the end said culvert section and mounted on a corresponding said footer, and each said precast wing wall including a rigidly connected precast wall anchor projecting laterally from said wing wall substantially beyond the corresponding said footer and into the ground above said footer.

18. A culvert assembly as defined in claim 17 and including a set of angular tie plates and threaded fasteners rigidly connecting each said wing wall to the adjacent said end culvert section.

19. A culvert assembly as defined in claim 17 wherein each said wall anchor includes an outer flange wall connected to the corresponding said wing wall by a web wall disposed generally perpendicular to said wing wall.

20. A culvert assembly as defined in claim 19 wherein said flange wall of each said anchor has a lower end portion projecting downwardly below the corresponding said web wall and the top of the corresponding said footer, and a body of concrete between said lower end portion and the adjacent said footer for securing said wall anchor relative to said footer.

21. A concrete culvert assembly comprising a set of elongated footers, a plurality of precast tapered concrete culvert sections mounted on said footers in longitudinal alignment, each of said culvert sections having an open bottom and including parallel spaced side walls having bottom surfaces resting on said footers, a top wall integrally connecting said side walls of each said section, said side walls of each said section having opposing inner surfaces defining a span greater than the length of said side and top walls, one of said side walls of each said culvert section having a length less than the length of the other said side wall to provide for curving said culvert assembly, each of said side walls and said top wall of each said section having outer surfaces forming a relatively sharp corner, reinforcing members embedded in said concrete of each said section and extending generally parallel to said outer surfaces of said top and side walls, and said inner surfaces of each said side wall and said top wall of each said section cooperating with said relatively sharp corner to define a corner thickness greater than the thickness of said side walls.

22. A culvert assembly as defined in claim 21 wherein each of said tapered culvert sections has one end surface normal to said side walls and the opposite end surface inclined relative to said side walls.

* * * * *